United States Patent [19]

Lloyd

[11] 4,329,905

[45] May 18, 1982

[54] SOUND GENERATING APPARATUS

[76] Inventor: Max T. Lloyd, Rte. 2, Dickerson, Md. 20753

[21] Appl. No.: 196,328

[22] Filed: Oct. 14, 1980

[51] Int. Cl.[3] ..... G10D 13/02; G10K 11/00

[52] U.S. Cl. ..... 84/411 R; 181/177

[58] Field of Search ..... 84/411 R, 330, 387 R, 84/411 M–421 M; 181/177, 184, 187, 188

[56] References Cited

U.S. PATENT DOCUMENTS 3,621,749 11/1971 Aluisi ..... 84/411 R

*Primary Examiner*—L. T. Hix
*Assistant Examiner*—Benjamin R. Fuller
*Attorney, Agent, or Firm*—Lowe, King, Price & Becker

[57] ABSTRACT

A portable apparatus (100) for mechanically amplifying voice and percussive sound includes a flared horn (10) with a horn mouth (26) and voice opening (28) for projecting sound in a desired directional sound radiation pattern. Within an opening formed in the body of the horn, a vibratile membrane (20) is secured by a retaining ring (22). The vibratile membrane (20) is tensioned to produce a drum sound when excited by percussion. Two handles (12) are mounted to the outer surface of the horn to enable lefthanded and righthanded persons to conveniently hold the horn. The horn is of frustoconical shape and appropriate dimensioning of the horn flare in relation to the width of the horn mouth defines a structure operable to permit the sound waves to cling to the horn inner surface and project outwardly therefrom.

14 Claims, 10 Drawing Figures

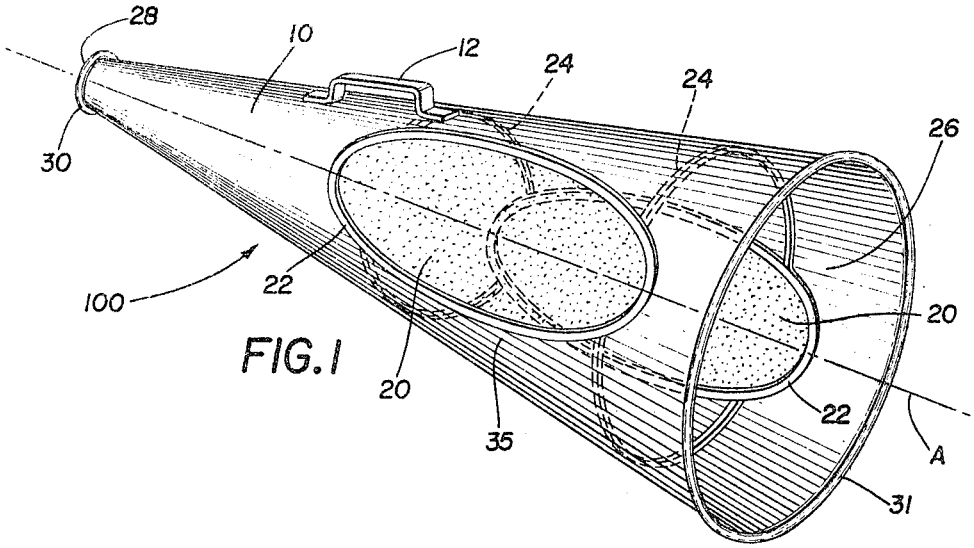
FIG. 1
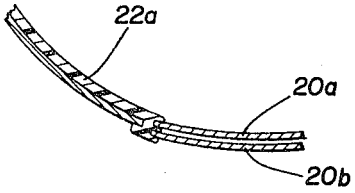
FIG. 7a
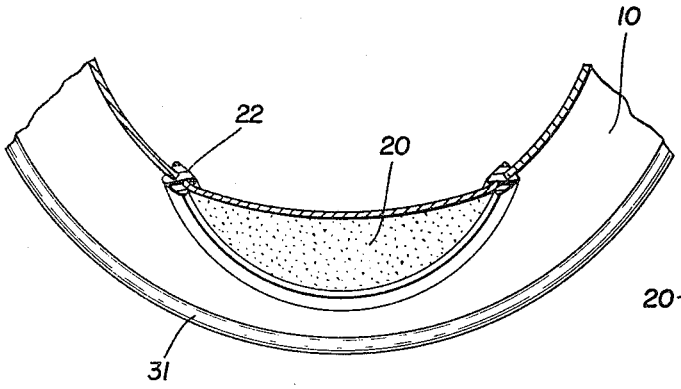
FIG. 6
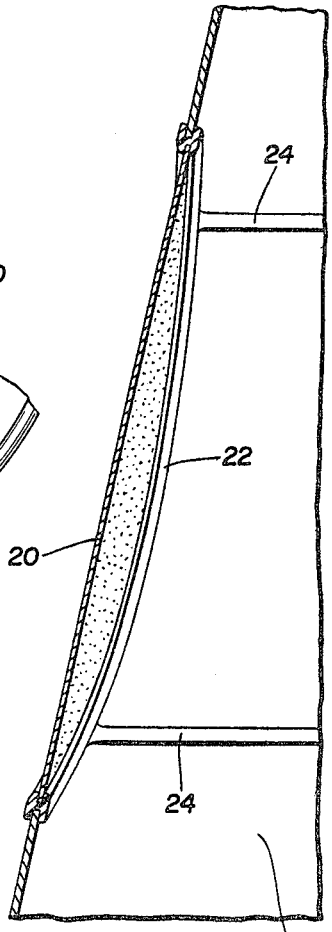
FIG. 8
FIG. 7
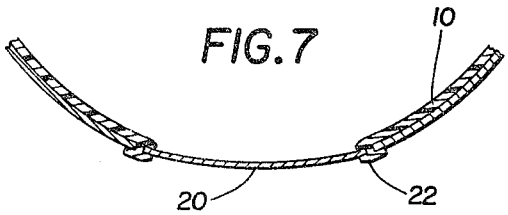

SOUND GENERATING APPARATUS

BACKGROUND ART

This invention generally relates to the mechanical amplification of voice and percussion produced sound at crowded spectator events, and more particularly to the adaptation of a megaphone to include vibratory membranes formed in openings of the megaphone tube such that when the membranes are excited by percussion, the drummed sound produced is concentrated in a directed beam radiated in one direction.

The use of separate megaphone and percussion instruments at sporting and other crowded spectator events is well known. Typically, megaphones are used to broadcast chants and other messages at a level of loudness above the normal din of the crowd, by concentrating the voice-produced sound into a directed beam so that most of the radiated sound energy is transmitted in one direction. Sometimes percussion instruments, such as drums, complement the use of megaphones by producing sounds of deinite pitch and timber or marking rhythm and otherwise producing special effects, depending upon the vibratory characteristics of the drum and the effect desired. In conventional, simultaneous use of drums and megaphones, different persons are required to operate each device which necessitates a degree of cooperation and coordination to produce the desired effect, in addition to the availability of such personnel to perform the individual functions. Also, the high cost of drums, especially for teams on a low budget, sometimes precludes their use at such events with the resulting inability to produce the desired effect.

In cases where both drum and megaphonic sound is available, the drum is usually used to produce sound with no definite pitch to mark rhythm or establish cadence. Drum membranes with a relatively high degree of tension are used to produce such sound; however, due to the high degree of tension in such membranes to achieve the desired effect, the membranes have a naturally short, vibratory period and are known to produce sound waves at relatively low noise levels which are often not heard by the crowd, in part due to the omnidirectional sound pattern radiating from the drum. In cases where drums are not available, megaphone operators sometimes strike the walls of the megaphone to produce a drum sound. However, the walls of the megaphone are poor soundboards and any vibration of the walls produces very little sound. Therefore, at events where both voice and percussion sound amplification are desired, conventional megaphones appear to make poor air resonators to produce drum sounds, whereas separate drum instruments used to produce sound to mark rhythm often operate at low sound levels and are not effective.

DISCLOSURE OF INVENTION

It is accordingly an object of the present invention to provide an apparatus capable of producing and amplifying both voice and drum sound at sufficient noise levels to be heard by spectators.

Another object of the invention is to provide such an apparatus of simple manufacture and low cost.

Yet another object is to provide such an apparatus operable by one person.

Still another object is to provide such an apparatus capable of producing sound at different pitch and noise levels.

Additional objects, advantages, and novel features of the invention will be set forth in part in the description which follows and in part will become apparent to those skilled in the art upon examination of the following, or may be learned by practice of the invention. The objects and advantages of the invention may be realized and obtained by means of the instrumentalities and combinations particularly pointed out in the appended claims.

An apparatus of the present invention, hereinafter termed "megadrumphone", for producing both voice and percussion amplified sound, comprises a flared horn, including a horn mouth and a voice opening for projecting sound in a desired directional sound radiation pattern. A vibratile membrane is secured within an opening formed in the body of the horn. The membrane is appropriately tensioned to produce a drum sound when excited by percussion.

The megadrumphone may also include a plurality of vibratile membranes dimensioned differently from each other to produce sounds of different pitch when excited by percussion. Two handles suitably positioned and attached to the horn facilitate use by lefthanded and righthanded persons. Appropriate dimensioning of the horn flare in relation to the width of the horn mouth defines a structure operable to permit the sound waves to cling to the horn inner surface and project outwardly therefrom.

BRIEF DESCRIPTION OF DRAWINGS

FIG. 1 is a perspective view of one embodiment of a megadrumphone, in accordance with the invention, illustrating two vibratile membranes placed in diametrically opposed positions on the horn position;

FIG. 6 is a partial sectional view of the megadrumphone taken along the line 6—6 of FIG. 2, illustrating the retaining structure of the vibratile membrane within the wall of the horn position;

FIG. 7 is a partial sectional view of the megadrumphone taken along the line 7—7 of FIG. 2;

FIG. 7*a* is a partial sectional view of another embodiment of the megadrumphone;

FIG. 8 is a partial sectional view of the megadrumphone taken along the line 8—8 of FIG. 2.

Figure 2:
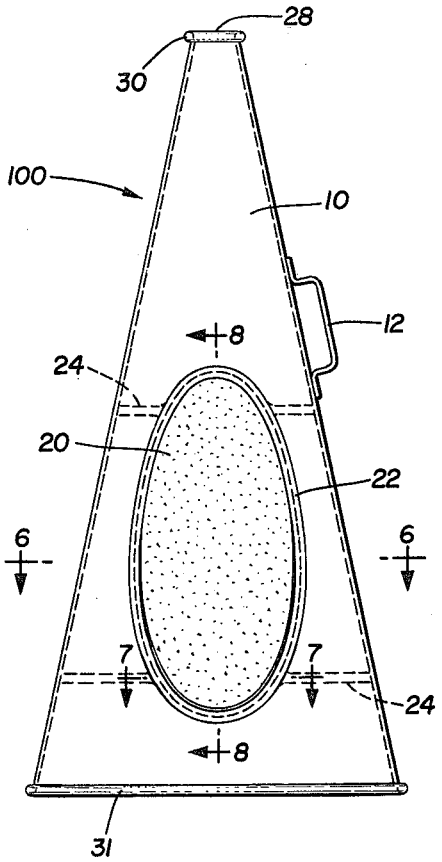
FIGS. 2 and 3 are side plan views illustrating the relative positioning of the handle and drum portions on the megadrumphone of FIG. 1.

BEST MODE FOR CARRYING OUT THE INVENTION:

Reference will now be made in detail to the present preferred embodiment of the invention, an example of which is illustrated in the accompanying drawings. Referring first to FIG. 1, an apparatus 100, hereinafter termed "megadrumphone", comprises a flared horn portion 10 with a handle 12 attached to the outer surface of horn 10 to facilitate gripping and using the horn. The horn 10 in FIG. 1 is of a frusto-conical shape and includes voice opening 28 and horn mouth 26, which are reinforced and defined by end hoops 30, 31. Horn 10 may be constructed from a hard cardboard or plastic material. Openings are then formed within the horn portion 10 for placement of a vibratile membrane 20. The openings correspond, in general, to the shape of the vibratile membrane, and in FIG. 1, such openings are elliptically shaped. However, it will be understood that other shapes may be employed (e.g., circular), and that the shape of the membrane boundary line will affect vibration of the membrane and, thus the sound emitted.

In the embodiment shown in FIG. 1, the purpose of the horn portion 10 is to concentrate the sound into a directed beam so that most of the radiated energy emanates in one direction. Generally, the mouth and flare of the horn play a major role in determining the directional characteristics. For example, the horn mouth width will tend to define the sound directional pattern in the range where the sound wavelength is greater than the horn mouth width. Where the sound wavelength is less than the horn mouth width, the flare of the horn will govern the sound directional pattern. Also, the horn must not flare too rapidly, because the sound waves will then not cling to the inner surface of the horn and spread out, but rather will act as though they were already in free space. A more elaborate discussion of horn shapes may be found in *Musical Engineering*, Olson, Harry Ferdinand, New York, McGraw-Hill, 1952. Accordingly, different horn shapes (e.g., exponential and catenoidal shaped horns) may be used in the present invention, as long as the above conditions are considered.

FIGS. 6 and 7 show use of gasket-retaining means to interfit membrane 20 within the wall of horn 10. Preferably, such gasket means include a membrane retaining ring 22, having two U-shaped channels adapted to mate with the wall of horn 10, and the boundary of membrane 20. In assembly of drum section 35, which includes membrane 20 and retaining ring 22, it may be convenient to secure membrane 20 within the channel of ring 22 prior to securing the drum section to the horn portion of the megadrumphone. Such a forming process will facilitate the process of shrinking the vibratile membrane 20 with heat and moisture application in order to produce appropriate tension within the membrane. After placement of the drum section within the opening of horn 10, reinforcing hoops 24 may be circumferentially disposed along the inner surface of wall 10 and integrally attached to retaining ring 22 to resist bending of the walls of horn portion 10 when drum section 35 is excited by percussion.

Figure 4:
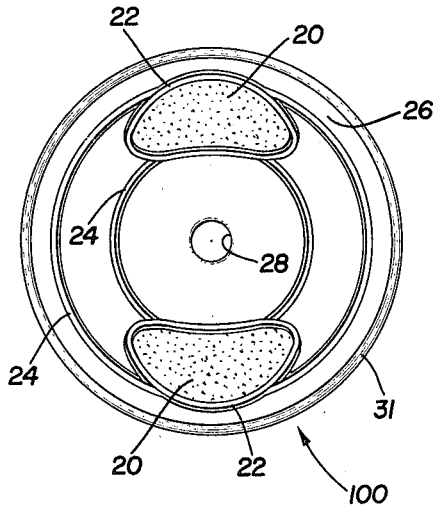
FIG. 4 is a bottom plan view of the megadrumphone.
Figure 5:
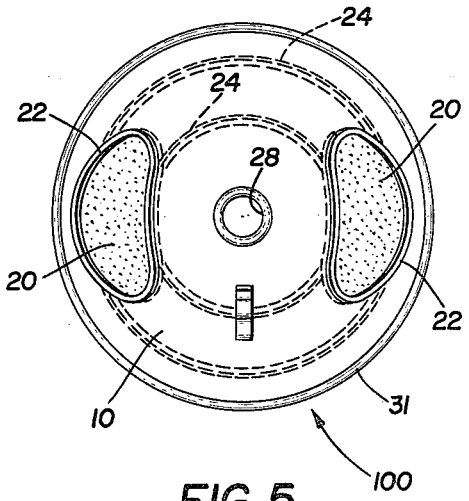
FIG. 5 is a top plan view of the megadrumphone.

As shown in FIGS. 1, 4 and 5, two vibratile membranes 20, having approximately similar shapes, are placed within the walls of horn portion 10. However, it will be understood that membranes of different shapes and sizes may be employed to achieve a drum sound of a different pitch. The pitch of membrane 20 may also be affected by retaining ring 22. For example, if a firmly clamped membrane under greater tension capable of vibrating at a higher pitch is desired, it is preferable to construct the gasket from a hard cardboard material, including steel rings (not shown). If a loosely clamped membrane, i.e., one capable of producing sounds of lower pitch, is desired, a soft rubber gasket may be used to secure the membrane within the opening of the horn wall.

Figure 9:
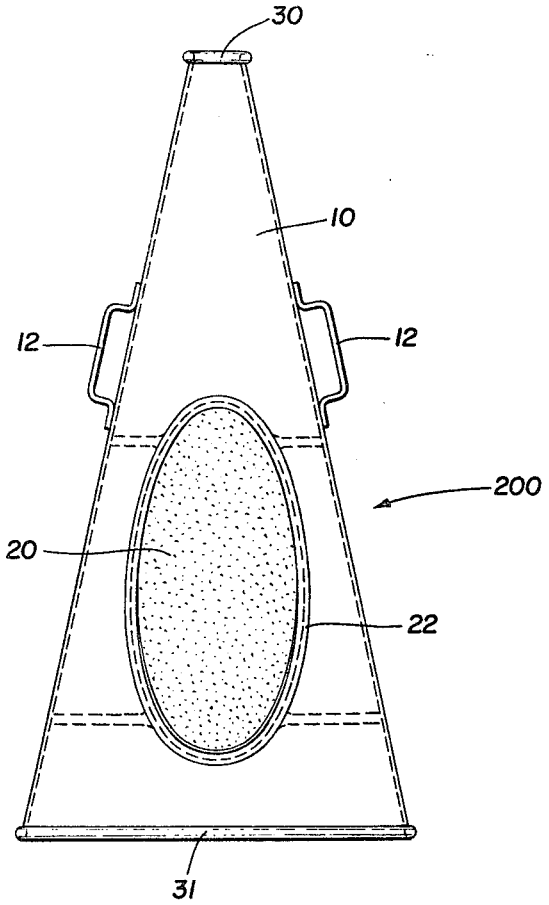
FIG. 9 is a side plan view of another embodiment of the megadrumphone comprising one vibratile membrane and two diametrically opposed handles.

FIG. 9 illustrates a different embodiment of a megadrumphone 200, in which two handles 12 are mounted to the outer surface of the horn. The use of two handles placed in substantially diametrically opposed positions along the wall of the horn will enable lefthanded, as well as righthanded, persons to use the same horn. It may also prove desirable to place only one drum section operable to produce the desired drum sound effect within the horn wall in situations where the presence of a plurality of drum sections may weaken the structural rigidity of the horn wall.

In another embodiment of the present invention, as best shown in FIG. *7a*, a drum section includes two vibratile members 20*a* and 20*b* secured to the section and spaced apart from each other by retaining ring 22*a*. In this embodiment, the drum section produces sound resembling a snare drum.

The full advantage of this invention may best be realized through a discussion of the operation of megadrumphone 100, 200. As stated previously, the megadrumphones employed in the present invention are defined by a voice opening 28 and an outwardly flaring horn 10, terminating in a horn mouth 26. In a frustoconical shaped horn, a constant angle, shown in FIG. 1, defines this shape.

When the megadrumphone 100, 200, as herein described, is used in a voice mode, it will be understood that sound waves produced at voice opening 28 radiate outwardly and orthogonally to central axis A (FIG. 1) within the volume of the tube, thus concentrating the sound energy in substantially one direction. Further, the membrane tends to resonate sympathetically and thus reinforce the soundwaves.

Figure 3:
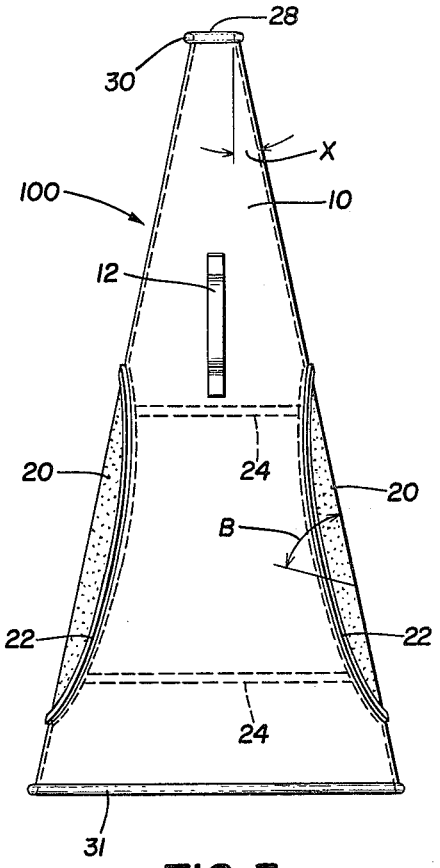

When the megadrumphone is used in a drum mode, two different sound effects result. When the vibratile membrane is excited by percussion, the air column defined by the membrane and opposite wall of the horn will begin to vibrate. Depending upon the vibratory characteristics of the membrane, omni-directional sound will be transmitted from the vibrating membrane itself. In addition, the sound waves produced by the vibrating air column within the megadrumphone will also strike the inner wall of the megadrumphone opposite the membrane at an angle B in FIG. 3 (B is equal to 90° minus 2X, where X is the angle of horn flare measured between axis A and the inner wall of the megadrumphone). The sound waves will then be reflected against the opposite wall of the tube at angle B. Thus, a component of the reflected drum sound waves radiate outward in a direction parallel to axis A in a manner similar to that of the voice produced sound energy. In the embodiments of the present invention, it is thus possible to generate an amplified drum sound which will radiate outwardly from the megadrumphone in a desired unidirectional sound pattern.

The foregoing description of the preferred embodiment of the present invention has been presented for purposes of illustration and description. It is not intended to be exhaustive or to limit the invention to the precise form disclosed, and obviously many modifications and variations are possible in light of the above teachings. The embodiment was chosen and described in order to best explain the principles of the invention and its practical application to thereby enable others skilled in the art to best utilize the invention and various embodiments and with various modifications as are suited to the particular use contemplated. It is intended that the scope of the invention be defined by the claims appended hereto.

I claim:

1. A portable sound generating device for mechanically amplifying voice and percussive sound in an assembly of unitary construction comprising:

(a) a flared horn portion including a horn mouth and a voice opening for projecting sound in a desired directional sound radiation pattern; and (b) vibratile membrane means secured within and substantially entirely covering an opening formed in the body of said horn portion, and appropriately tensioned to produce a drum sound when excited by percussion.

2. The device according to claim 1, further comprising gasket-retaining means to secure said vibratile membrane within said opening.

3. The device according to claim 1, wherein said vibratile membrane means comprises a plurality of vibratile membranes spaced apart from each other on said horn portion.

4. The device according to claim 3, wherein said vibratile membranes are differently dimensioned to produce sounds of different pitches when excited by percussion.

5. The device of claim 1, further comprising first and second diametrically opposed handles attached to the outer surface of said horn portion to facilitate holding by lefthanded and righthanded persons.

6. A sound generating device comprising a frustoconical shaped horn portion with first and second handles attached to an outer surface of said horn in substantially longitudinally corresponding and diametrically opposed positions, said horn portion including a vibratile membrane means excitable by percussion secured by a retaining ring means within an opening formed in the surface of said horn.

7. The device according to claim 1, wherein the shape of the horn is frusto-conical.

8. The device according to claim 1 or 6, wherein the vibratile membrane means is circular.

9. The device according to claim 1 or 6, wherein the vibratile membrane means is elliptical.

10. The device according to claim 2, wherein said gasket retaining means comprises a cardboard retaining ring including steel ring means to firmly clamp the vibratile member means to said horn and thereby tension said vibratile member means so as to produce drum sound when excited by percussion.

11. The device according to claim 2, wherein said gasket-retaining means is a soft rubber gasket.

12. The device according to claim 1 or 5, further comprising reinforcement means to resist bending of said horn portion when the membrane means is excited by percussion.

13. The device according to claim 2 or 10, wherein said reinforcement means include at least two reinforcing hoops disposed substantially circumferentially along the inner surface of said horn portion and integrally secured to said gasket retaining means to resist bending of the horn when said membrane means is excited by percussion.

14. The device according to claim 1 or 6, wherein said vibratile membrane means includes first and second membranes spaced apart from each other as to simulate a snare drum sound when excited by percussion.

* * * * *